US011441434B2

(12) United States Patent
Danis et al.

(10) Patent No.: US 11,441,434 B2
(45) Date of Patent: Sep. 13, 2022

(54) TURBINE RING ASSEMBLY WITH CURVED RECTILINEAR SEATINGS

(71) Applicant: SAFRAN AIRCRAFT ENGINES, Paris (FR)

(72) Inventors: Antoine Claude Michel Etienne Danis, Moissy-Cramayel (FR); Sébastien Serge Francis Congratel, Moissy-Cramayel (FR); Clément Jean Pierre Duffau, Moissy-Cramayel (FR); Lucien Henri Jacques Quennehen, Moissy-Cramayel (FR); Nicolas Paul Tableau, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/311,892

(22) PCT Filed: Dec. 10, 2019

(86) PCT No.: PCT/FR2019/052989
§ 371 (c)(1),
(2) Date: Jun. 8, 2021

(87) PCT Pub. No.: WO2020/128222
PCT Pub. Date: Jun. 25, 2020

(65) Prior Publication Data

US 2022/0025775 A1 Jan. 27, 2022

(30) Foreign Application Priority Data

Dec. 19, 2018 (FR) ..... 18 73403

(51) Int. Cl.
*F01D 9/04* (2006.01)
*F01D 25/24* (2006.01)
*F01D 11/08* (2006.01)

(52) U.S. Cl.
CPC ..... *F01D 9/04* (2013.01); *F01D 11/08* (2013.01); *F01D 25/246* (2013.01);
(Continued)

(58) Field of Classification Search
None
See application file for complete search history.

(56) References Cited

U.S. PATENT DOCUMENTS 8,905,709 B2 * 12/2014 Dziech ..... F01D 25/246 415/173.1
10,301,960 B2 * 5/2019 Stapleton ..... F01D 9/04
(Continued)

FOREIGN PATENT DOCUMENTS

FR 3 055 146 A1 2/2018
FR 3 055 147 A1 2/2018
WO WO-2017103451 A1 * 6/2017 ..... F01D 11/025

OTHER PUBLICATIONS

International Search Report dated Mar. 26, 2020 in PCT/FR2019/052989 filed on Dec. 10, 2019, 2 pages.
(Continued)

*Primary Examiner* — Courtney D Heinle
*Assistant Examiner* — Jason Fountain
(74) *Attorney, Agent, or Firm* — Oblon, McClelland, Maier & Neustadt, L.L.P.

(57) ABSTRACT

A turbine ring assembly including ring sectors forming a turbine ring and a ring support structure, each sector having, in a section plane defined by an axial direction and a radial direction of the ring, a first and a second attachment tabs extending in the radial direction, and the structure including a central shell ring from which extend as projections a first and a second radial flanges between which are retained the first and second attachment tabs of each sector. Each sector includes rectilinear seatings mounted on the faces of the first
(Continued)

and second attachment tabs in contact, respectively, with the second annular flange and the annular ring-flange and including, along a tangent to the circumferential direction, a variable thickness in the axial direction with a minimum thickness at the first and second ends of the sector and a maximum thickness in a median portion of the rectilinear seating.

10 Claims, 5 Drawing Sheets

(52) U.S. Cl.
CPC ..... *F05D 2240/11* (2013.01); *F05D 2240/14* (2013.01); *F05D 2260/30* (2013.01)

(56) References Cited

U.S. PATENT DOCUMENTS

| | | | | |
|---|---|---|---|---|
| 10,378,386 | B2 * | 8/2019 | Roussille | F01D 11/025 |
| 2012/0082540 | A1 * | 4/2012 | Dziech | F01D 11/125<br>415/173.1 |
| 2017/0016341 | A1 * | 1/2017 | Stapleton | F01D 25/246 |
| 2018/0051581 | A1 | 2/2018 | Quennehen et al. | |
| 2018/0051591 | A1 | 2/2018 | Quennehen et al. | |
| 2018/0363507 | A1 * | 12/2018 | Roussille | F01D 11/18 |

OTHER PUBLICATIONS

Preliminary French Search Report dated Sep. 6, 2019 in French Patent Application No. 18 73403 filed on Dec. 19, 2018 (with translation of category of cited documents), 3 pages.

* cited by examiner

TURBINE RING ASSEMBLY WITH CURVED RECTILINEAR SEATINGS

TECHNICAL FIELD

The invention relates to a turbine ring assembly comprising a plurality of ring sectors of ceramic matrix composite material as well as a ring support structure.

PRIOR ART

The field of application of the invention is in particular that of gas turbine aeronautical engines. The invention is, however, applicable to other turbomachines, for example to industrial turbines.

In the case of entirely metallic turbine ring assemblies, it is necessary to cool all the elements of the assembly and in particular the turbine ring which is subjected to the hottest flows. This cooling has a significant impact on the performance of the engine because the cooling flow used is drawn from the main flow of the engine. In addition, the use of metal for the turbine ring limits the possibilities of increasing the temperature at the turbine, which however would allow improving the performance of aeronautical engines.

In order to attempt to solve these problems, it has been considered to make turbine ring sectors of ceramic matrix composite (CMC) materials in order to dispense with the implementation of a metallic material.

CMC materials have good mechanical properties making them able to constitute structural elements and advantageously retain these properties at elevated temperatures. The implementation of CMC materials has advantageously allowed reducing the cooling flow to be imposed during operation and therefore to increase the performance of turbomachines. In addition, the implementation of CMC materials advantageously allows decreasing the mass of turbomachines and reducing the effect of heat dilation encountered with metallic parts.

However, proposed existing solutions can implement an assembly of a CMC ring sector with metallic attachment parts in a ring support structure, these attachment parts being subjected to the hot flow. Consequently, these metal attachment parts undergo heat dilation, which can lead to mechanical stresses on the CMC ring sectors and fragilization of the latter.

Moreover, documents FR 2 540 939, GB 2 480 766, EP 1 350 927, U.S. 2014/0271145, U.S. 2012/082540 and FR 2 955 898 are known which disclose turbine ring assemblies.

There exists a need to improve existing turbine ring assemblies and their assembly, and in particular existing turbine ring assemblies implementing a CMC material, in order to reduce the intensity of the mechanical stresses to which the CMC ring sectors are subjected during the operation of the turbine.

To accomplish all these objectives, it is known to use a pi-shaped ring held radially at four points. Four pins pass through the high-pressure turbine casing and an upstream ring-flange. The latter is fastened by means of a screw and a nut to the high-pressure turbine casing, and forms an axial abutment. The four pins form a radial abutment of the stream.

Axially, the ring is held between two metallic tabs. The downstream tab is directly linked to the casing, describing a single-piece ring, ensuring increased sealing relative to a solution with a sectored spacer. The upstream tab comprises a sectored ring-flange screwed to the casing.

These two metallic tabs comprise a lip in order to better control ring/casing sealing. For each ring sector, this lip is rectilinear so that there is always line contact, and thus good sealing, even if the ring tilts.

Another ring-flange is dedicated to taking up the force of the high-pressure guide nozzle (DHP force). It allows taking up the DHP force and transferring it directly to the casing without having the forces transit through the CMC ring.

To ensure axial contact under hot conditions between the ring and the rectilinear lips of the upstream and downstream tabs, pre-clamping is carried out during assembly. This pre-clamping allows taking up the differential axial dilation between the CMC ring and the metal parts in contact. Thus, under hot conditions, axial contact is retained and the sealing between the stream cavity and the out-of-stream cavity is ensured.

Given the annular geometry of the downstream flange of the casing on the one hand, and the sectored nature of the facing ring, axial contact between the rectilinear lips of the two parts, under stress, generates nonuniform forces in the tangential direction on the CMC ring. This phenomenon is explained by the fact that the distance between the rectilinear seating and the cylindrical upper part of the annular casing, or 360° casing, varies tangentially. This distance is less at the inter-sectors of the CMC ring than in its center. The lever arm between the rectilinear seating and the cylindrical upper part of the 360° casing is therefore smaller at the inter-sectors. When the pre-clamping is applied at the axial contact, the casing is therefore deformed less and transmits more force to the CMC ring at the intersectors than at the center of the ring.

This axial support against the downstream flange of the CMC ring, higher at the inter-sectors, consequently generates larger bending stresses in these zones. This bending of the downstream flange results in tension forces at the surface between the flange of the CMC ring and the downstream tab of the 360° casing that are higher at the inter-sectors than at the center of the ring.

Given the weakness of allowable forces for CMC, these stress concentrations must be attenuated.

DISCLOSURE OF THE INVENTION

The invention seeks to propose a turbine ring assembly allowing the deterministic retention of each ring sector, i.e. so as to control its position and avoid having it vibrate, on the one hand, while allowing the ring sector, and by extension the ring, to deform under the influence of increases in temperature and pressure variations, this in particular independently of the interface metallic parts and, on the other hand, while improving the sealing and simplifying the handling and reducing their number for assembling the ring assembly.

One object of the invention proposes a turbine ring assembly comprising a plurality of ring sectors forming a turbine ring and a ring support structure. Each ring sector has, in a section plane defined by an axial direction and a radial direction of the turbine ring, and orthogonal to a circumferential direction of the turbine ring, a part forming an annular base with, in the radial direction of the turbine ring, an internal face defining the internal face of the turbine ring and an external face from which extend as projections a first and a second attachment tabs.

The ring support structure includes a central shell ring from which extend as projections a first and a second radial flanges between which are held the first and second attachment tabs of each ring sector and an annular ring-flange including a free first end seated against the first attachment tab and a second end opposite to the first end and cooperating with the first radial flange of the central shell ring of the ring support structure.

Each ring sector extends between a first circumferential end and a second circumferential end each intended to face another ring sector in the circumferential direction, and comprising rectilinear seating surfaces mounted on the faces of the first and second attachment tabs in contact, respectively, with the second annular flange and the annular ring-flange and extending along a tangent to the circumferential direction between the first and second circumferential ends of the ring sector.

According to a general feature of the object, the rectilinear seating surfaces of each ring sector have, along the tangent to the circumferential direction, a variable thickness in the axial direction with a minimum thickness at the first and second circumferential ends of the ring sector and a maximum thickness in a median portion of the rectilinear seating.

The geometric conformation of the rectilinear seating surfaces allows making uniform the distribution of the contact stresses between the sectored CMC rings and the annular ring support structure. The camber of the rectilinear seatings allows, on the one hand, lowering the maximum stress level in the CMC ring by 80% at assembly and by 20% in operation, relative to a solution for an equivalent mass, with a straight rectilinear seating, i.e. a rectilinear seating having a thickness in the axial direction which is uniform along the tangent to the circumferential direction.

The cambered shapes of the rectilinear seatings can be produced by electrical discharge machining (EDM).

One important point for this technology is the "camber" value, namely the distance between the highest point and the lowest point of the seating. In the case of the CMC ring, the value is comprised between 0.1 and 0.5 mm.

In one particular embodiment, the ring sectors can be of ceramic matrix composite material (CMC).

According to a first aspect of the turbine ring assembly, the rectilinear seating surfaces can be electrical discharge machined surfaces, i.e. produced by electrical discharge machining.

According to a second aspect of the turbine ring assembly, the gap between said maximum thickness and said minimum thickness of the rectilinear seating surfaces can be 0.1 mm.

According to a third aspect of the turbine ring assembly, the minimum thickness of the rectilinear seating surfaces can be less than 0.1 mm.

The tighter the tolerance relative to camber, the better the behavior of the camber. The shape of the camber, which corresponds to the value of the radius, can vary depending on the desired deformations.

According to a fourth aspect of the turbine ring assembly, the rectilinear seating surfaces can form a strip extending along said tangent to the circumferential direction ($D_C$) and along the radial direction, the rectilinear seating surfaces having a height extending in the radial direction comprised between 0.5 and 5 mm.

Depending on the part facing the rectilinear seating surfaces, as well as the stresses and the leakage levels, the height of the seatings can vary. Beyond 5 mm a seating would be too pronounced, and below 0.5 mm the risk of non-contact is too high.

According to a fifth aspect of the turbine ring assembly, the rectilinear seating surfaces of each ring sector can comprise, in the radial direction, a first radial end and a second radial end, and have, along the radial direction, a variable thickness in the axial direction with a minimum thickness at the radial ends of the ring sector and a maximum thickness in a median portion of the rectilinear seating.

According to a sixth aspect of the turbine ring assembly, the rectilinear seating surfaces can have a first axis of symmetry parallel to the radial direction and a second axis of symmetry parallel to the tangent to the circumferential direction.

According to a seventh aspect of the turbine ring assembly, the ring sector can have a cross-section like the inverted Greek letter pi ($\pi$) in the section plane defined by the axial direction and the radial direction, and the assembly can comprise, for each ring sector, at least three pins to radially retain the ring sector in position, the first and second attachment tabs of each ring sector each comprising a first end integral with the external face of the annular base, a free second end, at least three lugs for receiving said at least three pins, at least two lugs extending as projections from the second end of one of the first or second attachment tabs in the radial direction of the turbine ring and at least one lug extending as a projection from the second end of the other attachment tab in the radial direction of the turbine ring, each reception lug including an opening for receiving one of the pins.

According to an eighth aspect of the turbine ring assembly, the ring sector can have, over at least one radial range of the ring sector, an O cross section in the section plane defined by the axial direction and the radial direction, the first and second attachment tabs each having a first end integral with the external face and a free second end, and each ring sector comprising a third and a fourth attachment tabs each extending, in the axial direction of the turbine ring, between a second end of the first attachment tab and a second end of the second attachment tab, each ring sector being fastened to the ring support structure by a fastening screw including a screw head seated against the ring support structure and a thread cooperating with a tapped opening formed in a fastening plate, the fastening plate cooperating with the third and fourth attachment tabs. The ring sector also comprises radial pins extending between the central shell ring and the third and fourth attachment tabs.

Another object of the invention proposes a turbomachine comprising a turbine ring assembly as defined above.

BRIEF DESCRIPTION OF THE DRAWINGS

The invention will be better understood upon reading the text below, by way of indication but without limitation, with reference to the appended drawings in which.

DESCRIPTION OF THE EMBODIMENTS

Figure 1:
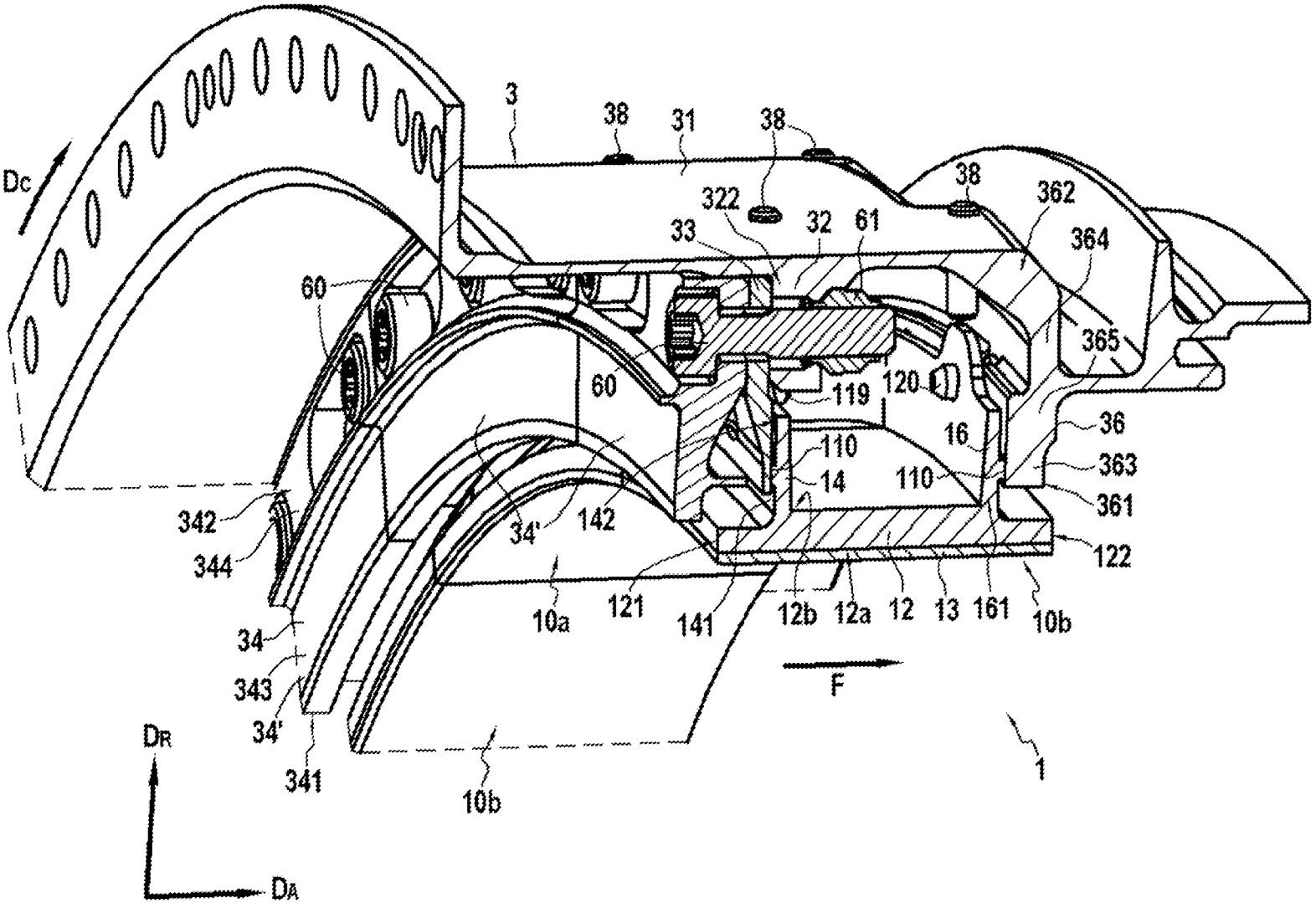
FIG. 1 is a perspective schematic view of a first embodiment of a turbine ring assembly according to the invention.

FIG. 1 shows a high-pressure turbine ring assembly comprising a turbine ring 1 of ceramic matrix composite (CMC) material and a metallic ring support structure 3. The turbine ring 1 surrounds an assembly of rotating blades (not shown). The turbine ring 2 is formed from a plurality of ring sectors 10, FIG. 1 being a radial section view. The arrow $D_A$ indicates the axial direction of the turbine ring 1 while the arrow $D_R$ indicates the radial direction of the turbine ring 1. For reasons of simplifying the presentation, FIG. 1 is a partial view of the turbine ring 1 which in reality is a complete ring.

Figure 2:
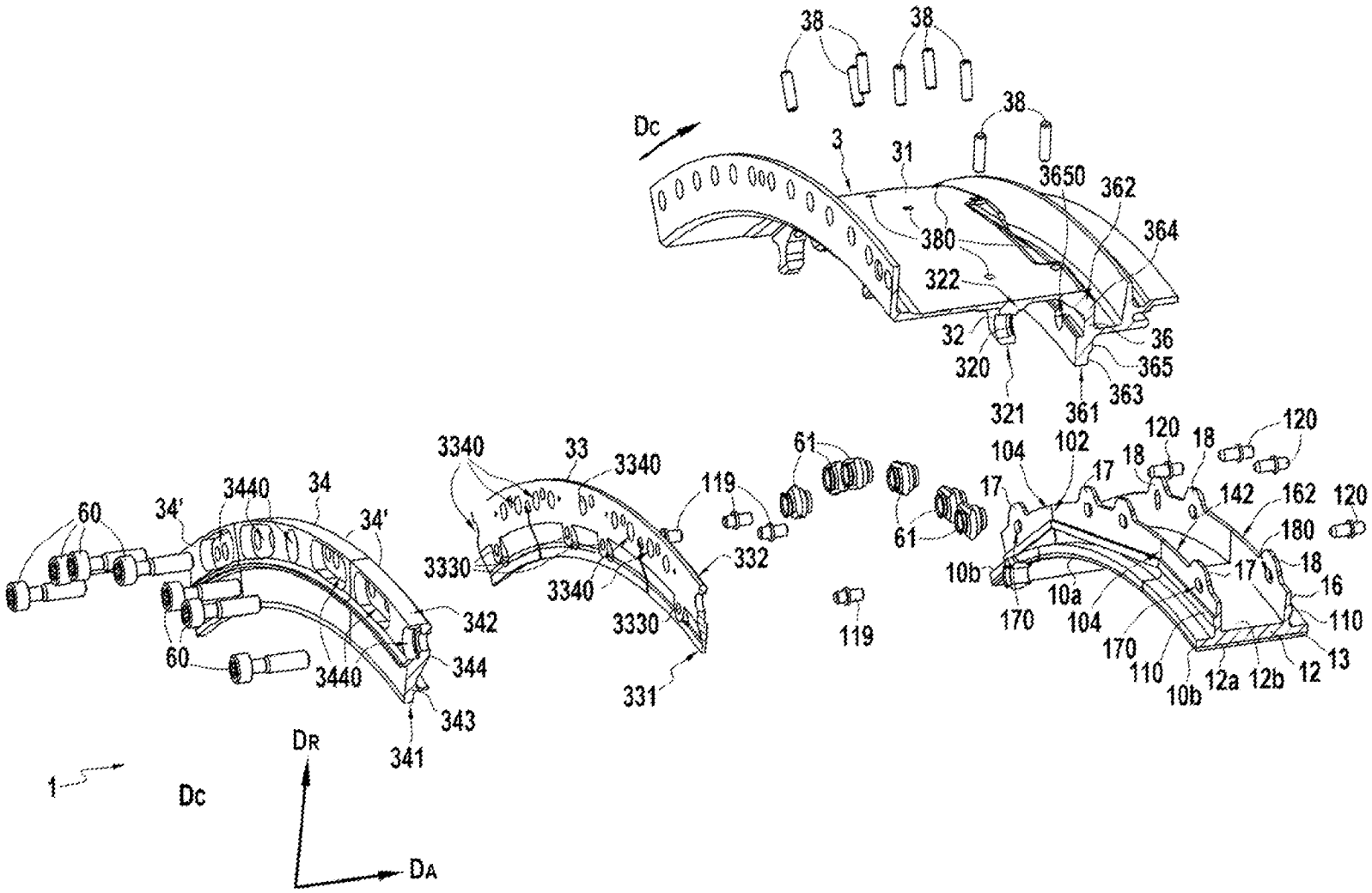
FIG. 2 is an exploded perspective schematic view of the turbine ring assembly of FIG. 1.
Figure 3:
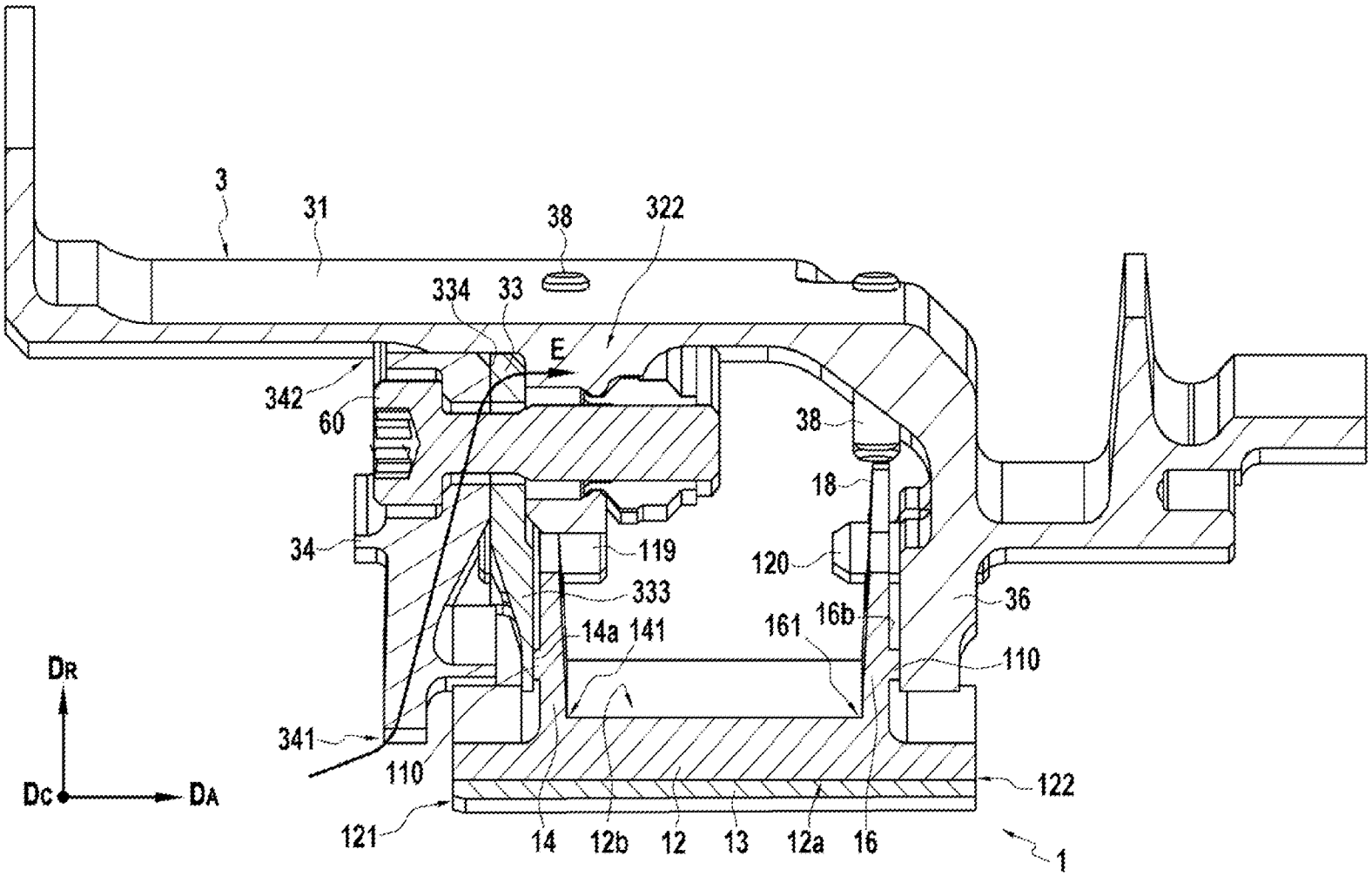
FIG. 3 is a schematic section view of the turbine ring assembly of FIG. 1.

As illustrated in FIGS. 2 and 3 which respectively show a schematic exploded perspective view and a section view of the turbine ring assembly of FIG. 1, the section view being in a section plane comprising the radial direction $D_R$ and the axial direction $D_A$, each ring sector 10 has, in a plane defined by the axial $D_A$ and radial $D_R$ directions, a cross section substantially in the shape of an inverted Greek letter π. In fact, the cross section comprises an annular base 12 and upstream and downstream radial attachment tabs, respectively 14 and 16. The terms "upstream" and "downstream" are used here with reference to the flow direction of the gas flow in the turbine shown by the arrow F in FIG. 1. The tabs of the ring sector 10 could have any other shape, the cross section of the ring sector having shape other than π, such as an O shape for example.

The annular base 12 includes, in the radial direction $D_R$ of the ring 1, an internal face 12*a* and an external face 12*b* opposite to one another. The internal face 12*a* of the annular base 12 is coated with a layer 13 of abradable material forming a thermal barrier and designed to cooperate with the rotating blades of the turbine. The terms "internal" and "external" are used here with reference to the radial direction $D_R$ in the turbine.

The upstream and downstream radial attachment tabs 14 and 16 extend as projections, in the direction $D_R$, from the external face 12*b* of the annular base 12 at a distance from the upstream and downstream ends 121 and 122 of the annular base 12. The upstream and downstream radial attachment tabs 14 and 16 extend over the entire width of the ring sector 10, i.e. over the entire circular arc described by the ring sector 10, or over the entire circumferential length of the ring sector 10.

In FIGS. 1 and 2, the turbine ring 1 portion shown comprises a complete ring sector 10 surrounded by two half ring sectors 10. For better understanding, the complete ring sector is designated 10*a* and the half ring sectors are designated 10*b* in FIG. 2. Hereafter, the ring sectors will be designated 10 to designate both 10*a* and 10*b*.

As illustrated in FIGS. 1 to 3, the ring support structure 3 which is integrated with a turbine casing comprises a central shell ring 31, extending in the axial direction $D_A$, and having an axis of revolution congruent with the axis of revolution of the turbine ring 1 when they are fastened together, as well as a first annular radial flange 32 and a second radial flange 36, the first annular radial flange 32 being positioned upstream of the second annular radial flange 36 which is therefore located downstream of the first annular radial flange 32.

The second annular radial flange 36 extends in the circumferential direction of the ring 1 and in the radial direction $D_R$, from the central shell ring 31 to the center of the ring 1. It comprises a free first end 361 and a second end 362 integrated with the central shell ring 31. The second annular flange 36 includes a first portion 363, a second portion 364 and a third portion 365 comprised between the first portion 363 and the second portion 364. The first portion 363 extends between the first end 361 and the third portion 365, and the second portion 364 extends between the third portion 365 and the second end 362. The first portion 363 of the second annular radial flange 36 is in contact with the downstream fastening radial flange 16. The first portion 363 and the third portion 365 have increased thickness relative to that of the second portion 364 to offer increased stiffness to the second radial flange relative to the upstream portion including in particular the first radial flange 32, so as to decrease axial leakage from the ring in the case of a rectilinear seating.

The first annular radial flange 32 extends in the circumferential direction of the ring 1, and in the radial direction $D_R$, from the central shell ring 31 to the center of the ring 1. It comprises a free first end 321 and a second end 322 integrated with the central shell ring 31.

As illustrated in FIGS. 1 to 3, the turbine ring assembly 1 comprises a first annular ring-flange 33 and a second annular ring-flange 34, the two annular ring-flanges 33 and 34 being fastened removably to the first annular radial flange 32. The first and second annular ring-flanges 33 and 34 are positioned upstream of the turbine ring 1 relative to the direction of flow F of the gas flow in the turbine.

The first annular ring-flange 33 is positioned downstream of the second annular ring-flange 34. The first annular ring-flange 33 is of a single piece while the second annular ring-flange 34 can be sectored into a plurality of annular second ring-flange sectors 34 or be of a single piece. Incorporating a first single piece annular ring-flange, not sectored in other words, allows ensuring the axial sealing between the sectored CMC ring and the annular casing, particularly by avoiding inter-sector leaks, relative to a case where the upstream ring-flange is sectored.

The first annular ring-flange 33 has a free first end 331 and a second end 332 fastened removably to the ring support structure 3, and more particularly to the first annular radial flange 32. In addition, the first annular ring-flange 33 has a first portion 333 and a second portion 334, the first portion 333 extending between the first end 331 and the second portion 334, and the second portion 334 extending between the first portion 333 and the second end 332.

The second annular ring-flange 34 has a free first end 341 and a second end 342 opposite to the first end 341 and in contact with the central sell ring or central crown 31. The second end 342 of the second annular ring-flange 34 is also removably fastened to the ring support structure 3, and more particularly to the first annular radial flange 32. The second annular ring-flange 34 also comprises a first portion 343 and a second portion 344, the first portion 343 extending between the first end 341 and the second portion 344, and the second portion 344 extending between the first portion 343 and the second end 342.

The first portion 333 of the first upstream ring-flange 33 is seated on the upstream radial attachment tab 14 of the ring sector 10. The first and second upstream ring-flanges 33 and 34 are formed to have the first portions 333 and 343 in contact, the two ring-flanges 33 and 34 being removably fastened on the upstream annular radial flange 32 using fastening screws 60 and nuts 61, the screws 60 passing through openings 3340, 3440 and 320 provided respectively in the second portions 334 and 344 of the two upstream ring-flanges 33 and 34 as well as in the upstream annular radial flange 32.

When the ring assembly 1 is assembled, the first portion 333 of the first annular ring-flange 33 is located seated against the upstream radial attachment tab 14 of each of the ring sectors 10 composing the turbine ring 1, and the second portion 334 of the first annular ring-flange 34 is located seated against at least a portion of the first annular radial flange 32.

The second annular ring-flange 34 is dedicated to taking on the force of the high-pressure guide nozzle (DHP) and the ring assembly 1 by making this force transit to the casing line which is more robust mechanically, i.e. to the line of the ring support structure 3 as illustrated by the force arrows E presented in FIG. 3. The residual force, which passes through the first upstream ring-flange 33 is reduced because the first portion 333 of the first upstream ring-flange 33 has a reduced cross section, and is therefore more flexible, which allows applying a minimum force to the CMC ring 1.

In the axial direction $D_A$, the second annular radial flange 36 of the ring support structure 3 is separated from the first annular ring-flange 33 by a distance corresponding to the separation of the upstream and downstream radial attachment tabs 14 and 16 so as to retain the latter between the first annular radial flange 32 and the second annular radial flange 36.

To retain the ring sectors 10 in position, and therefore the turbine ring 1, with the ring support structure 3, the ring assembly comprises two first pins 19 cooperating with the upstream attachment tabs 14 and the first annular ring-flange 33, and two second pins 20 cooperating with the downstream attachment tab 16 and the second annular radial flange 36.

For each corresponding ring sector 10, the second portion 334 of the first annular ring-flange 33 comprises two openings 3340 for receiving two first pins 19, and the third portion 365 of the annular radial flange 36 comprises two openings 3650 configured to receive the two second pins 120.

For each ring sector 10, each of the upstream and downstream radial attachment tabs 14 and 16 comprises a first end, 141 and 161, integral with the external face 12*b* of the annular base 12 and a free second end, 142 et 162. The second end 142 of the upstream radial attachment tab 14 comprises two first lugs 17 each including an opening 170 configured to receive a first pin 119. Similarly, the second end 162 of the downstream radial attachment tab 16 comprises two second lugs 18 each including an opening 180 configured to receive a second pin 20. The first and second lugs 17 and 18 extend as projections in the radial direction $D_R$ of the turbine ring 1, respectively from the second end 142 of the upstream radial attachment tab 14 and from the second end 162 of the downstream radial attachment tab 16.

The openings 170 and 180 can be circular or oblong. Preferably, the set of openings 170 and 180 comprises one portion of circular openings and one portion of oblong openings. The circular openings allow tangentially indexing the rings and preventing them from moving tangentially (particularly in the event of blade tip rubbing). The oblong openings allow accommodating differential dilations between the CMC and the metal. The CMC has a much lower dilation coefficient than that of the metal. When hot, the lengths in the tangential direction of the ring sector and of the facing portion of the casing will therefore be different. If there were only circular openings, the metal casing would impose its displacements on the CMC ring, which would be the source of high mechanical stresses in the ring sector. Having oblong holes in the ring assembly allows the pin to slide in this hole and to avoid the overstress phenomenon mentioned above. Hence two drilling schemes could be imagined: a first drilling scheme, for a case with three lugs, would comprise one radial circular opening on a radial attachment flange and two tangential oblong openings on the other radial attachment flange, and a second drilling scheme, for a case with at least four lugs, would comprise one circular opening and one oblong opening per facing radial attachment flange in each case. Other ancillary cases can also be considered.

For each ring sector 10, the two first lugs 17 are positioned in two different angular positions relative to the axis of revolution of the turbine ring 1. Likewise, for each ring sector 10, the two second lugs 18 are positioned at two different angular positions relative to the axis of revolution of the turbine ring 1.

Each ring sector 10 also comprises rectilinear seating surfaces 110 mounted on the faces of the upstream and downstream radial attachment tabs 14 and 16 in contact respectively with the first annular ring-flange 33 and the second annular radial flange 36, i.e. on the upstream face 14*a* of the upstream radial attachment tab 14 and on the downstream face 16*b* of the downstream radial attachment tab 16.

The rectilinear seatings 110 allow having controlled sealing zones. In fact, the seating surfaces 110 between the upstream radial attachment tab 14 and the first annular ring-flange 33, on the one hand, and between the downstream radial attachment tab 16 and the second annular radial flange 36 are comprised in the same rectilinear plane.

More precisely, having seatings on radial planes allows dispensing with axial tilting effects of the turbine ring 1. In fact, during the tilting of the ring during operation, the rectilinear seating allows retaining a complete sealing line.

Figure 4:
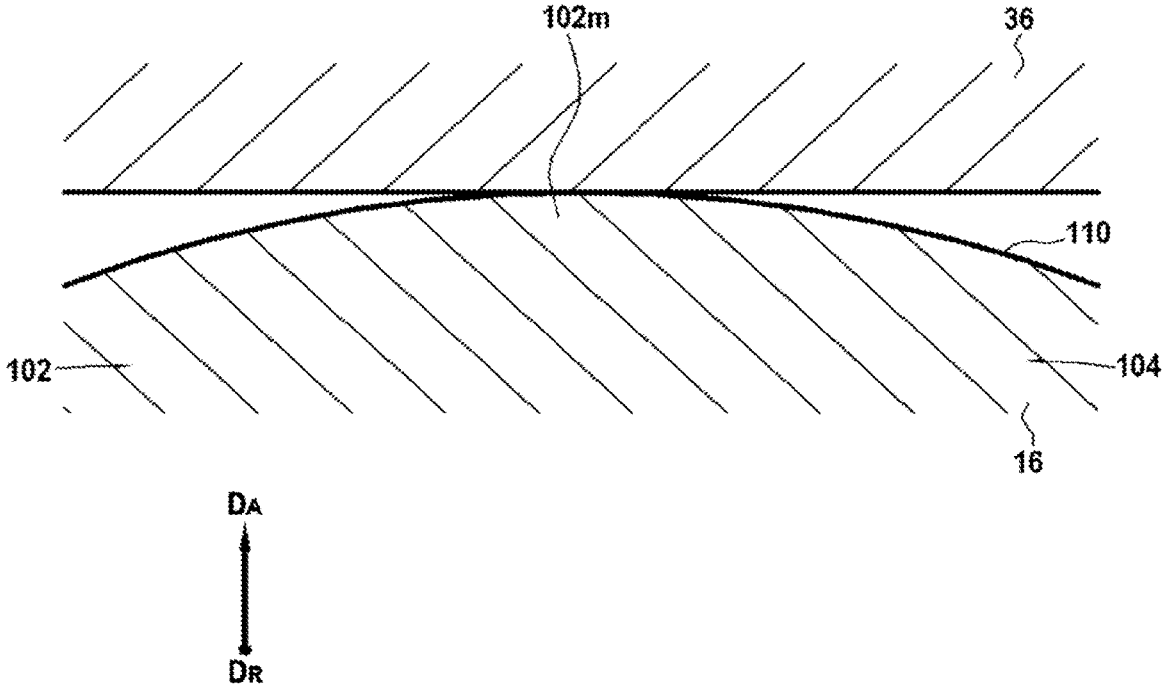
FIG. 4 is a schematic section view in to a first section plane of a rectilinear seating of the turbine ring assembly of FIG. 1.

As is illustrated more precisely in FIG. 4, which shows schematically a view of a rectilinear seating of the turbine ring assembly of FIG. 1 in a section plane orthogonal to the radial direction $D_R$, and comprising the axial direction $D_A$ and a tangent to the circumferential direction $D_C$, each rectilinear seating 110 comprises a thickness measured in the axial direction $D_A$ which varies along the rectilinear seating 110 in the direction of the tangent to the circumferential direction $D_C$. The measured thickness is a minimum at the ends of the rectilinear seating 110 and a maximum in a median region 110*m* of the rectilinear seating 110. The ends of the rectilinear seating 110 are located on either side of the ring sector 10 in the circumferential direction $D_C$, each end of the ring sector 10*a* facing another ring sector 10*b*. The ends of the rectilinear seating 110 of a ring sector 10 are adjacent to, or congruent with the circumferential ends 102 and 104 of the ring sector 10.

The minimum thickness of the rectilinear seatings 110 is less than 0.1 mm and the gap between the maximum thickness and the minimum thickness of the rectilinear seating surfaces 110 is 0.1 mm.

Figure 5:
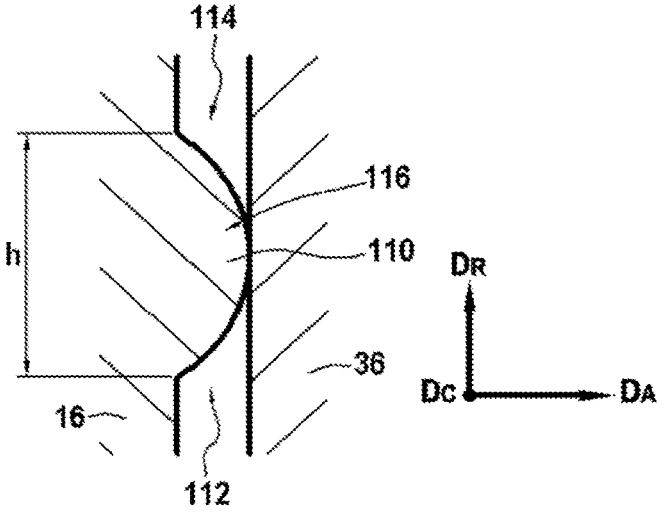
FIG. 5 shows schematically a section view of a rectilinear seating of the turbine ring assembly in a second section plane, according to a variant of the embodiment.

FIG. 5 shows schematically a view of a rectilinear seating of the turbine ring assembly in a section plane orthogonal to the circumferential direction $D_C$, and comprising the axial direction $D_A$ and the radial direction $D_R$, according to one variant of the embodiment.

As illustrated in FIGS. 4 and 5, the rectilinear seatings 110 form a strip extending along the tangent to the circumferential direction $D_C$ and along the radial direction $D_R$.

The rectilinear seatings 110 can comprise a uniform thickness in the radial direction or, as illustrated in FIG. 5, a variable thickness in the radial direction $D_R$. In FIG. 5, the rectilinear seatings 110 comprise, in the radial direction $D_R$, a first radial end 112 and a second radial end 114 and have, along the radial direction $D_R$, a variable thickness in the axial direction $D_A$ with a minimum thickness at the radial ends 112 and 114 of the ring sector 10 and a maximum thickness in a median portion 116 of the rectilinear seating 110.

The radial retention of the ring 1 is ensured by the first annular ring-flange 33 which is pressed on the first annular radial flange 32 of the ring support structure 3 and on the upstream radial attachment tab 14. The first annular ring-flange 33 ensures sealing between the stream cavity and the out-of-stream cavity of the ring.

The second annular ring-flange 34 ensures the link between the downstream portion of the DHP, the ring support structure 3, or casing, by radial surface contact, and the first annular ring-flange 33 by axial surface contact.

The ring support structure 3 also comprises radial pins 38 which allow pressing the ring into the low radial position, i.e. toward the stream, in a deterministic manner. There is in fact a clearance between the axial pins and the bores on the ring to compensate the differential dilation between the metal and the CMC elements which operates when hot. The radial pins 38 cooperate with openings 380 made in the radial direction $D_R$ in the central crown 31 of the ring support structure 3.

Figure 6:
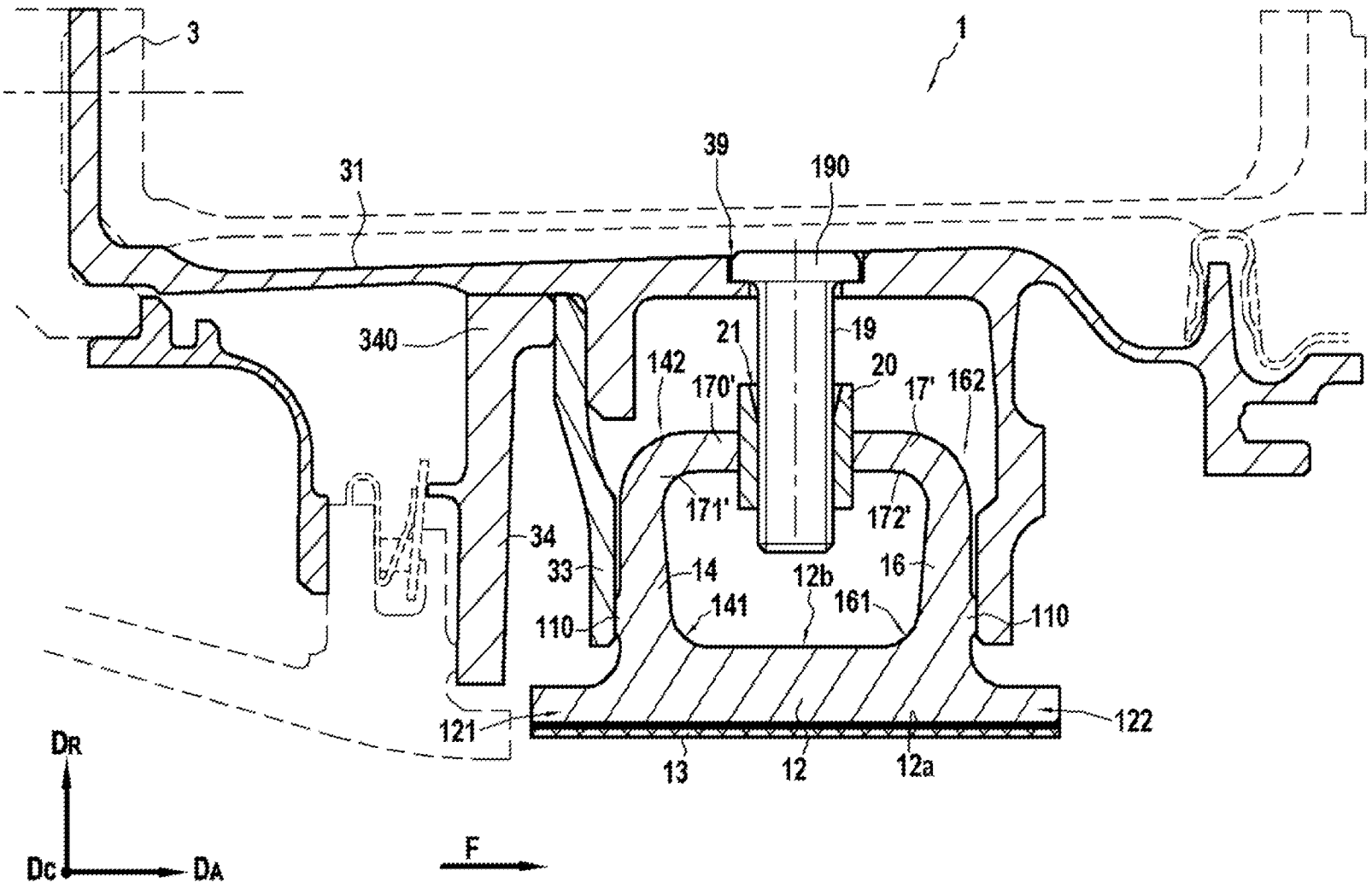
FIG. 6 shows a schematic section view of a second embodiment of the turbine ring assembly.

A schematic section view is presented in FIG. 6 of a second embodiment of the turbine ring assembly.

The second embodiment illustrated in FIG. 8 differs from the first embodiment illustrated in FIGS. 2 to 3 in that the ring sector 10 has, in the plane defined by the axial $D_A$ and radial $D_R$ directions on a portion of the ring sector 10, an O-shaped cross section instead of an inverted π shaped cross section, the ring section 10 being fastened to the ring support structure 3 by means of a screw 19 and a fastening part 20, the screws 38 being eliminated.

In the second embodiment illustrated in FIG. 6, the ring sector 10 comprises an axial attachment tab 17' extending between the upstream and downstream radial attachment tabs 14 and 16. The axial attachment tab 17' extends more precisely in the axial direction $D_A$, between the second end 142 of the upstream radial attachment tab 14 and the second end 162 of the downstream radial attachment tab 16.

The axial attachment tab 17' comprises an upstream end 171' and a downstream end 172' separated by a central portion 170'. The upstream and downstream ends 171' and 172' of the axial attachment tab 17' extend as projections, in the radial direction $D_R$, from the second end 142, 162 of the radial attachment tab 14, 16 to which they are coupled, so as to have an axial attachment tab 17' central portion 170' that is raised relative to the second ends 142 and 162 of the upstream and downstream radial attachment tabs 14 and 16.

For each ring sector 10, the turbine ring assembly comprises a screw 19 and a fastening part 20. The fastening part 20 is fastened to the axial attachment tab 17'.

The fastening part 20 also comprises an opening 21 provided with a threaded bore cooperating with a thread of the screw 19 to fasten the fastening part 20 to the screw 19. The screw 19 comprises a screw head 190 the diameter of which is greater than the diameter of an opening 39 made in the central shell ring 31 of the ring support structure 3 through which the screw 19 is inserted before being screwed to the fastening part 20.

The radial integration of the ring sector 10 with the ring support structure 3 is accomplished by means of the screw 19, the head 190 of which is seated on the central crown 31 of the ring support structure 3, and of the fastening part 20 screwed to the screw 19 and fastened to the axial attachment tab 17' of the ring sector 10, the screw head 190 and the fastening part 20 exerting forces in opposite direction to retain the ring assembly 1 and the ring support structure 3.

In one variant, the downward radial retention of the ring can be ensured by means of four radial pines pressed on the axial attachment tab 17', and the upward radial retention of the ring can be ensured by a pick-up head, integral with the screw 19, placed below the ring between the axial attachment tab 17' and the external face **12*b*** of the annular base.

Described now is a method for producing a turbine ring assembly corresponding to that shown in FIG. 1, i.e. according to the first embodiment illustrated in FIGS. 1 to 3.

Each ring sector 10 described above is made of ceramic matrix composite (CMC) material by forming a fibrous preform having a shape similar to that of the ring sector, and densification of the ring sector with a ceramic matrix.

For the production of the fibrous preform, it is possible to use yarns of ceramic fibers, for example yarns of SiC fibers such as those marketed by the Japanese firm Nippon Carbon under the name "Hi-NicalonS," or yarns of carbon fibers.

The fibrous preform is advantageously produced by three-dimensional weaving, or multi-layer weaving with the provision of disconnection zones allowing separating the parts of the preforms corresponding to the attachment tabs 14 and 16 of the sectors 10.

The weave can be of the interlock type, as illustrated. Other three-dimensional or multi-layer weave patterns can be used, such as for example multi-web or multi-satin weave patterns. Reference can be made to document WO 2006/136755.

After weaving, the blank can be formed to obtain a ring sector preform which is consolidated and densified by a ceramic matrix, the densification being able to be produced in particular by chemical infiltration in the gas phase (CVI) which is well known per se. In one variant, the textile preform can be slightly hardened by CVI so that it is sufficiently rigid to be handled, before causing liquid silicon to rise by capillary effect into the textile to cause densification ("melt infiltration").

A detailed example of the manufacture of ring sectors of DMC is described in particular in document U.S. 2012/0027572.

The ring support structure 3, for its part, is produced in a metallic material such as a Waspaloy® alloy or Inconel 718 or C263.

The production of the turbine ring assembly continues with the mounting of the ring sectors 10 on the ring support structure 3.

For this purpose, the ring sectors 10 are assembled together on an annular tool of the "spider" type including, for example, suction cups configured so that each retains a ring sector 10.

Then the two second pins 20 are inserted into the two openings 3650 provided in the third portion 365 of the second annular radial flange 36 of the ring support structure 3.

The ring 1 is then mounted on the ring support structure 3 by inserting each second pin 20 into each of the openings 180 of the second lugs 18 of the downstream radial attachment flanges 16 of each ring sector 10 composing the ring 1.

All the first pins 19 are then placed in the openings 170 provided in the first lugs 17 of the radial attachment tab 14 of the ring 1.

Then the first annular ring-flange 33 and the second annular ring-flange 34 are fastened to the ring support structure 3 and to the ring 1. The first and second annular ring-flanges 33 and 34 are fastened by interference fit to the ring support 3. The DHP force exerted in the direction of the flow F reinforces this fastening during the operation of the engine.

To retain the ring 1 in position radially, the first annular ring-flange 33 is fastened to the ring by inserting each first pin 19 into each of the openings 170 of the first lugs 17 of the upstream radial attachment tabs 14 of each ring sector 10 composing the ring 1.

The ring 1 is thus retained in position axially by means of the first annular ring-flange 33 and of the second annular radial flange seated respectively upstream and downstream on rectilinear seating surfaces 110 of the respectively upstream 14 and downstream 16 radial attachment tabs. During the installation of the first annular ring-flange 33, an axial preload can be applied to the first annular ring-flange 33 and to the upstream radial attachment tab 14 to palliate the effect of differential dilation between the CMC material of the ring 1 and the metal of the ring support structure 3. The first annular ring-flange 33 is retained in axial stress by mechanical elements placed upstream as illustrated in dotted lines in FIG. 3.

The ring 1 is retained in position radially by means of first and second pins 19 and 20 cooperating with the first and second lugs 17 and 18 and the openings 3340 and 3650 of the first annular ring-flange 33 and of the annular radial flange 36.

The invention thus provides a turbine ring assembly allowing the retention of each ring sector in a deterministic manner while allowing, on the one hand, the ring sector, and by extension the ring, to deform under the influence of increases in temperature and variations of pressure, this in particular independently of the interfaced metal parts and, on the other hand, while improving sealing and simplifying handling and by reducing their number for assembling the ring assembly.

The invention claimed is:

1. A turbine ring assembly comprising:

a plurality of ring sectors forming a turbine ring; and a ring support structure, each ring sector having, in a section plane defined by an axial direction and a radial direction of the ring and orthogonal to a circumferential direction of the turbine ring, a part forming an annular base with, in the radial direction of the turbine ring, an internal face defining the internal face of the turbine ring and an external face from which extend as projections a first and a second attachment tabs, the ring support structure including a central shell ring from which extend as projections a first radial flange and a second radial flange to retain each ring sector, and an annular ring-flange having a free first end seated against the first attachment tab and a second end opposite to the first end and cooperating with the first radial flange, each ring sector extending between a first circumferential end and a second circumferential end each intended to face another adjacent ring sector in the circumferential direction, and comprising a first rectilinear seating surface positioned on an upstream face of the first attachment tab in contact with the annular ring-flange and a second rectilinear seating surface positioned on a downstream face of the second attachment tab in contact with the second radial flange, each of the first and second rectilinear seating surfaces extending along a tangent to the circumferential direction between the first and second circumferential ends of the ring sector, wherein a downstream face of the annular-ring flange is only in axial contact with the first rectilinear seating surface, and an upstream face of the second radial flange is only in axial contact with the second rectilinear seating surface, and wherein the rectilinear seating surfaces of each ring sector have, along said tangent to the circumferential direction, a variable thickness in the axial direction with a minimum thickness at the first and second circumferential ends of the ring sector and a maximum thickness in a median portion of the rectilinear seating surface.

2. The assembly according to claim 1, wherein the rectilinear seating surfaces are electrical discharge machined surfaces.

3. The assembly according to claim 1, wherein a gap between said maximum thickness and said minimum thickness of the rectilinear seating surface is comprised between 0.1 and 0.5 mm.

4. The assembly according to claim 1, wherein the minimum thickness of the rectilinear seating surfaces is less than 0.1 mm.

5. The assembly according to claim 1, wherein the rectilinear seating surfaces form a strip extending along said tangent to the circumferential direction and along the radial direction, the rectilinear seating surfaces having a height extending along the radial direction comprised between 0.5 and 5 mm.

6. The assembly according to claim 5, wherein the rectilinear seating surfaces of each ring sector comprise, in the radial direction, a first radial end and a second radial end, and have, along the radial direction, a variable thickness in the axial direction with a minimum thickness at the radial ends of the ring sector and a maximum thickness in a radially median portion of the rectilinear seating.

7. The assembly according to claim 6, wherein the rectilinear seating surfaces have a first axis of symmetry parallel to the radial direction and a second axis of symmetry parallel to the tangent to the circumferential direction.

8. The assembly according to claim 1, wherein the ring sector has a pi cross section in the section plane defined by the axial direction and the radial direction, and the assembly comprises, for each ring sector, at least three pins to radially retain the ring sector in position, the first and second attachment tabs of each ring sector each comprising a first end integral with the external face of the annular base, a free second end, at least three lugs for receiving said at least three pins, at least two lugs extending as projections from the second end of one of the first or second attachment tabs in the radial direction of the turbine ring and at least one lug extending as a projection from the second end of the other attachment tab in the radial direction of the turbine ring, each reception lug including an opening for receiving one of the pins.

9. The assembly according to claim 1, wherein the ring sector has an O cross section in the section plane defined by the axial direction and the radial direction, the first and second attachment tabs each having a first end integral with the external face and a free second end, and each ring sector comprising a third and a fourth attachment tabs each extending, in the axial direction from the turbine ring, between the free second end of the first attachment tab and the free second end of the second attachment tab, each ring sector being fastened to the ring support structure by a fastening screw including a screw head seated against the ring support structure and a thread cooperating with a tapped opening formed in a fastening plate, the fastening plate cooperating with the third and fourth attachment tabs.

10. A turbomachine comprising a turbine ring assembly according to claim 1.

* * * * *